US011305529B2

(12) United States Patent
Molinet

(10) Patent No.: US 11,305,529 B2
(45) Date of Patent: Apr. 19, 2022

(54) GROUP REFERENCE

(71) Applicant: HEWLETT-PACKARD DEVELOPMENT COMPANY, L.P., Spring, TX (US)

(72) Inventor: Josep-Lluis Molinet, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 2 days.

(21) Appl. No.: 16/342,920

(22) PCT Filed: Jan. 27, 2017

(86) PCT No.: PCT/US2017/015277
§ 371 (c)(1),
(2) Date: Apr. 17, 2019

(87) PCT Pub. No.: WO2018/140025
PCT Pub. Date: Aug. 2, 2018

(65) Prior Publication Data

US 2020/0039212 A1 Feb. 6, 2020

(51) Int. Cl.
*B41J 29/38* (2006.01)
*B41J 2/045* (2006.01)

(52) U.S. Cl.
CPC ..... *B41J 2/04536* (2013.01); *B41J 2/0458* (2013.01); *B41J 2/04581* (2013.01)

(58) Field of Classification Search
None
See application file for complete search history.

(56) References Cited

U.S. PATENT DOCUMENTS 4,961,088 A * 10/1990 Gilliland ..... G03G 15/553 399/12
6,019,461 A 2/2000 Yoshimura et al.
6,672,695 B1 * 1/2004 Naka ..... B41J 2/17503 347/19
7,212,637 B2 5/2007 Salisbury
7,376,627 B2 5/2008 Adkins et al.
7,431,436 B1 10/2008 Mills et al.
7,950,766 B2 5/2011 Ejiri et al.
(Continued)

FOREIGN PATENT DOCUMENTS

WO WO-2008024884 A2 2/2008
WO WO-2015117679 A1 8/2015

OTHER PUBLICATIONS

HPDC, "International Search Report and Written Opinion," dated Sep. 14, 2817, International App. No. PCT/US2017/015277, 7 p.
(Continued)

*Primary Examiner* — Matthew Luu
*Assistant Examiner* — Tracey M McMillion
(74) *Attorney, Agent, or Firm* — HP Inc. Patent Department

(57) ABSTRACT

In an example, a print system is described and includes a supply interface to form electrical communication with a container of print fluid and a controller to retrieve data from a machine-readable medium coupled to the container, identify a container group identifier based on the retrieved data, and set a group flag based on a comparison of the container group identifier with data representing a group reference.

7 Claims, 4 Drawing Sheets

(56) References Cited

U.S. PATENT DOCUMENTS

| | | | | |
|---|---|---|---|---|
| 8,218,195 | B2 | 7/2012 | Lapstun et al. | |
| 2014/0375718 | A1 * | 12/2014 | Govyadinov ..... | B41J 2/0458<br>347/14 |

OTHER PUBLICATIONS

Epson, "Ink Cartridge Multipacks Help You Save Money—Epson," 3 p., downloaded Apr. 17, 2019. <<https;//www.epson.co.uk/viewcon/corporatesite/cms/index/10962/>>.

* cited by examiner

GROUP REFERENCE

BACKGROUND

Print systems generally deposit print fluid onto a medium to generate a printed article. A print system may have an interface for a print fluid supply to provide print fluid to the printer. A print system may utilize multiple supplies, such as print fluids with colorants. The print system may have an interface to couple a supply to the print system. For example, if a print fluid supply becomes empty, the interface may detach from a used supply and a new supply may be attached.

DETAILED DESCRIPTION

In the following description and figures, some example implementations of print apparatus, systems, and/or methods of operating a print system are described. In examples described herein, a "print device" may be a device to print content on a physical medium (e.g., paper or a layer of powder-based build material, etc.) with a printing fluid (e.g., ink or toner). For example, the print device may be a wide-format printing device that prints latex-based print fluid on a print medium, such as a print medium that is size A2 or larger. In the case of printing on a layer of powder-based build material, the printing device may utilize the deposition of printing fluids in a layer-wise additive manufacturing process. A print device may utilize suitable printing consumables, such as ink, toner, fluids or powders, or other raw materials for printing. In some examples, a printing device may be a three-dimensional (3D) printing device. An example of print fluid is a water-based latex ink ejectable from a print head, such as a piezoelectric print head or a thermal inkjet print head. Other examples of print fluid may include dye-based color inks, pigment-based inks, solvents, gloss enhancers, etc.

Various examples described below relate to operating a print system based on a group reference associated with a print fluid supply. By using a print system that is able to recognize a group identifier associated with a supply and compare it to a group reference, the print system may, for example, adapt operations to coordinate with an installed print supply. For example, a color calibration may or may not be enabled when a supply is inserted and recognized as within the same group as the previously inserted supply.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus.

Figure 1:
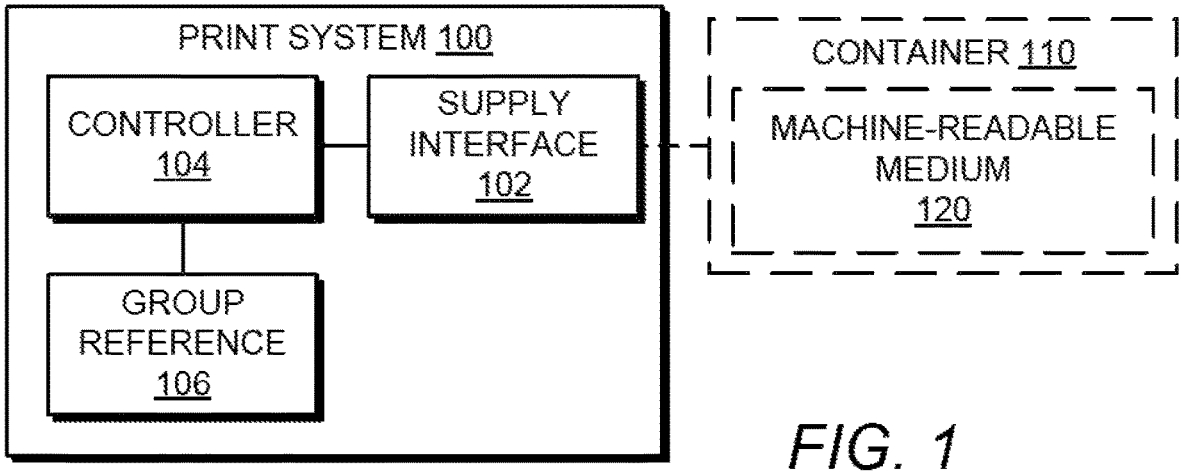
FIGS. 1 and 2 are block diagrams depicting example print systems.
Figure 2:
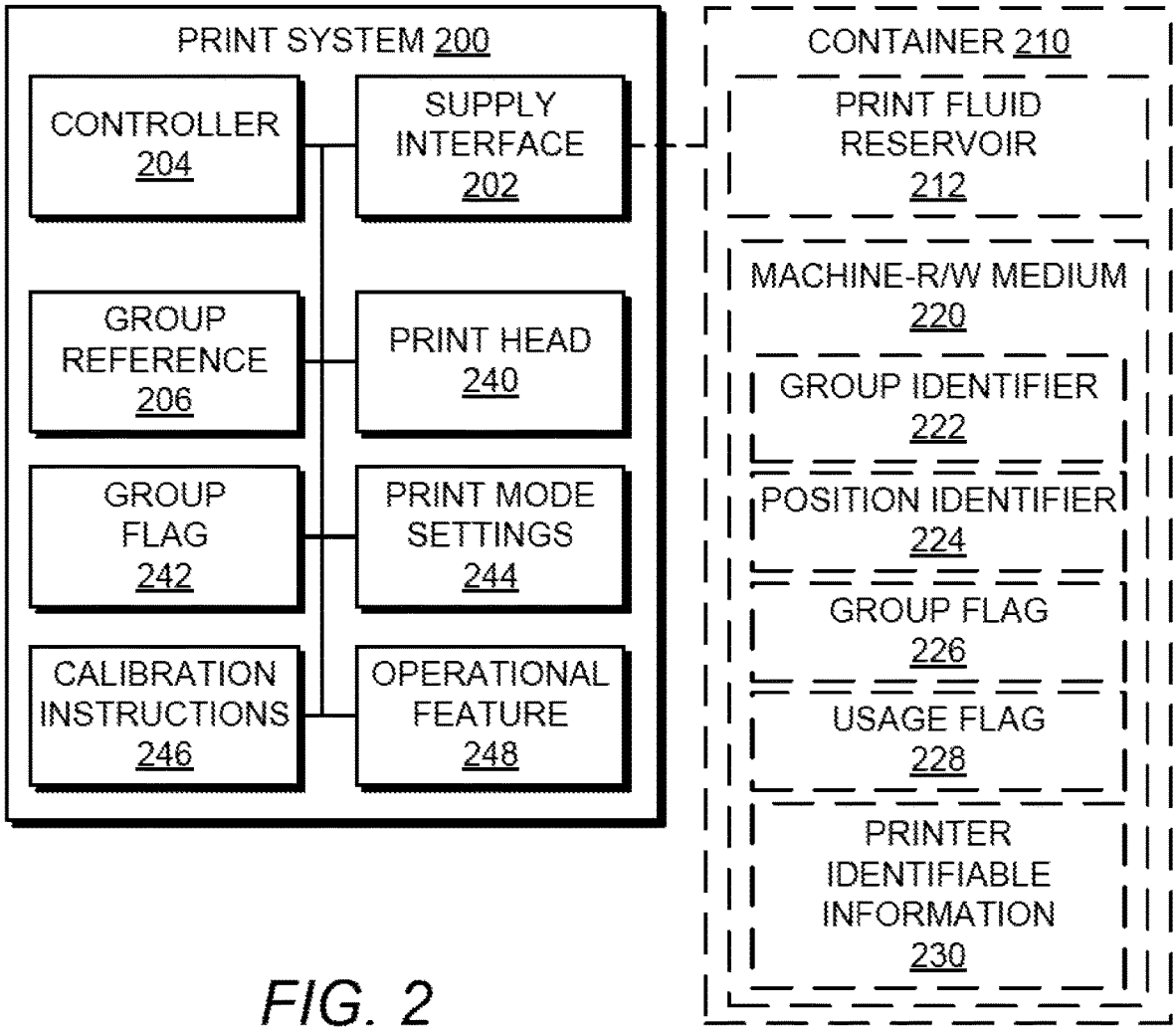

FIGS. 1 and 2 are block diagrams depicting example print systems 100 and 200. Referring to FIG. 1, the example print system 100 of FIG. 1 generally includes a supply interface

102 capable of connecting to a container 110 and a controller 104. In general, the controller 104 is able to receive, via the supply interface 102, information from a machine-readable medium 120 coupled to the container 110 when the container 110 is connected via the supply interface and make a comparison of the information associated with the container 110 to a group reference 106 to identify whether the container 110 is compatible with a group associated with the group reference 106. For example, the supply interface 102 of the print system 100 may provide a physical connection to form electrical communication (e.g., align electrical contact points on the print system 100 and the container 110) with a container 110 of print fluid and the controller 104 may execute operations to cause data retrieval from a machine-readable medium 120 coupled to the container 110; cause identification of a group associated with the container 110 based on the retrieved data; and cause a comparison of the identified container group to a group reference 106. A "group reference" or any identifiers discussed herein may be any number, value, character, string, or symbol capable of representing a group associated with a supply. The print system 100 may perform operations based on the comparison of the container group to the group reference, such as display a message on a control panel and/or perform color calibration. For example, the controller 104 may retrieve a serial number from the machine readable medium 120, compute a container group identifier from the serial number, and display a message indicating that the container belongs to the same group as expected by the system when the group reference matches the computed container group identifier or display a message indicating that the container does not belong to the expected group.

Referring to FIG. 2, the print system 200 is similar to print system 100 and includes a supply interface 202 and a controller 204 that are the same as the supply interface 102 and the controller 104 of print system 100 of FIG. 1, and includes additional details regarding operations of the print system 200 and the container 210. FIG. 2 depicts the print system 200 including a print head 240, a group flag 242, print mode settings 244, calibration instructions 246, and an operational feature 248. FIG. 2 further depicts the container 210 including a print fluid reservoir 212. In this example, the supply interface 202 may provide fluidic communication between the print fluid reservoir 212 and the print head 240 as well as electrical communication between a data storage medium 220 of the container 210 and the controller 204 of the print system 200.

FIG. 2 further depicts a medium 220 that is machine-readable similar to medium 120 of FIG. 1, but is also machine-writable. The medium 220 includes memory locations for data associated with the container 210, such as a group identifier 222, a position identifier 224, a group flag 226, a usage flag 228, and printer identifiable information 230. In other examples, the supply may have multiple mediums coupled to the container 210, such as machine-readable medium for the serial number (e.g., container group identifier 222) and a separate machine-read/writeable medium for flags 226 and 228 or printer identifiable information 230 that is updatable based on the print system 200. As used herein, "printer identifiable information" may be any number, value, character, string, or other symbol capable of representing information particular to the print system 200, such as a printer serial number, a model number, a brand name, or an internet protocol address. As used herein, a "flag" represents a state or condition and may be a number, value, character, string, or other symbol capable of representing the state or condition. For example, a flag may represent state of usage of a supply or a whether a supply is part of the group associated with the group reference, etc.

In one example, the controller 204 may retrieve the group identifier 222 and position identifier 224 from medium 220 via the supply interface and use the group identifier 222 and/or position identifier 224 in a comparison with the group reference 206. A group flag 242 (or group flag 226 on the container depending on implementation) may be set based on a comparison of the container group identifier 222 with data representing a group reference 206 from the print system 200. The print system 200 may perform operations based on the state of the group flag 242 (and/or 226). For example, the group flag 242 may be set to indicate a mismatch between the group reference 206 and the group identifier 222 and the controller 204 may execute calibration instructions 246 to calibrate the print head 240, change a print setting (e.g., switch print modes), or disable an operational feature 248 that is associated with the group reference 206. An example of an operational feature 248 may be a curing mechanism, for example, if the container group identifier matches a group reference associated with latex-based ink, then a curing mechanism may be activated. In another example, a print system 200 may use two black inks, where, in response to a comparison of the group reference with data from the container 210, the installation of a first black ink type activates operation with a first set of media types and the installation of the second black ink type activates operation with a second set of media types. In yet another example, the group flag 242 may indicate that the container 210 is in the expected group associated with the group reference and the print mode/settings may be kept the same (e.g., without performing a color calibration for a newly installed cartridge of the same color batch group).

The position identifier 224 may be used for further specific identification of the supply within a group and may assist more particularized operation. For example, a plurality of supplies may be set with a propriety position to be used first while others with a relatively lower priority to be used later. Using further cartridge information may allow for the print system to implement levels of operation based on authorizations associated with the levels of groups, positions in the group, etc.

The print system 200 may, in response to the comparison of container information to the expected group information, interact with the container 210 or print components of the print system 200, such as the print head 240 or other operational feature 248. For example, the controller 204 may, in response to a determination that the group flag 242 indicates a mismatch between the container group identifier 222 and the group reference 206, cause data to be written to a machine-writeable medium 220 coupled to the container 210 of the supply and/or update the group reference and cause a notification to a control panel on the print system 200 of any data modifications. For another example, the controller 204 may enable a print mode based on the group flag 242 or perform color calibration based on the group flag 242 using the calibration instructions 246.

The controller 204 may monitor the group flag 242 and make printer state adjustments accordingly. For example, the controller 204 may cause an interrupt routine to switch operational status of a feature 248 of the print system 200 in response to a change to the group flag 242.

The operations and settings of the print system 200 may be adjusted based on whether the container 210 has been used before in addition to the group data associated with the container. For example, the controller 204 may determine a usage flag status using the retrieved data and cause data to be written to a machine-writeable medium coupled to the container when the usage flag status indicates an initial use (such as updating the usage flag 228 or updating the printer identifiable information 230) or cause an override to perform color calibration even if the group identifier 222 matches the group reference 206.

Figure 3:
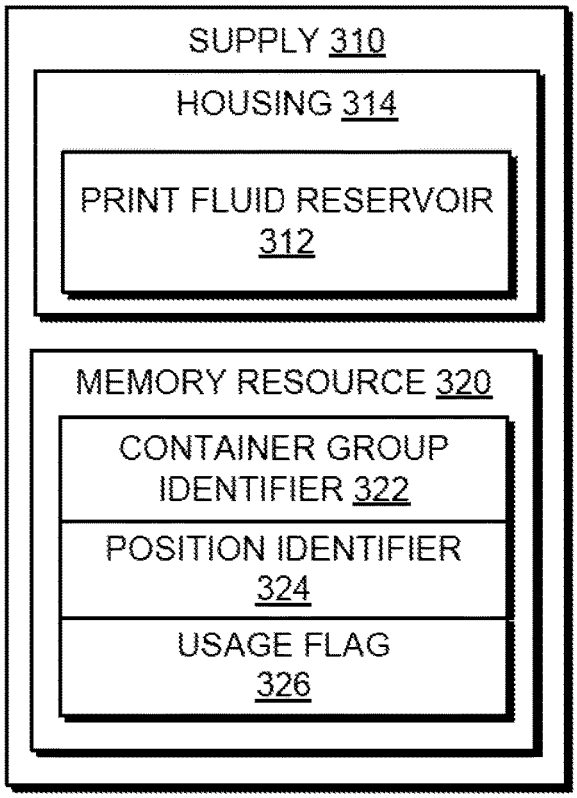
FIGS. 3 and 4 are block diagrams depicting example supplies.
Figure 4:
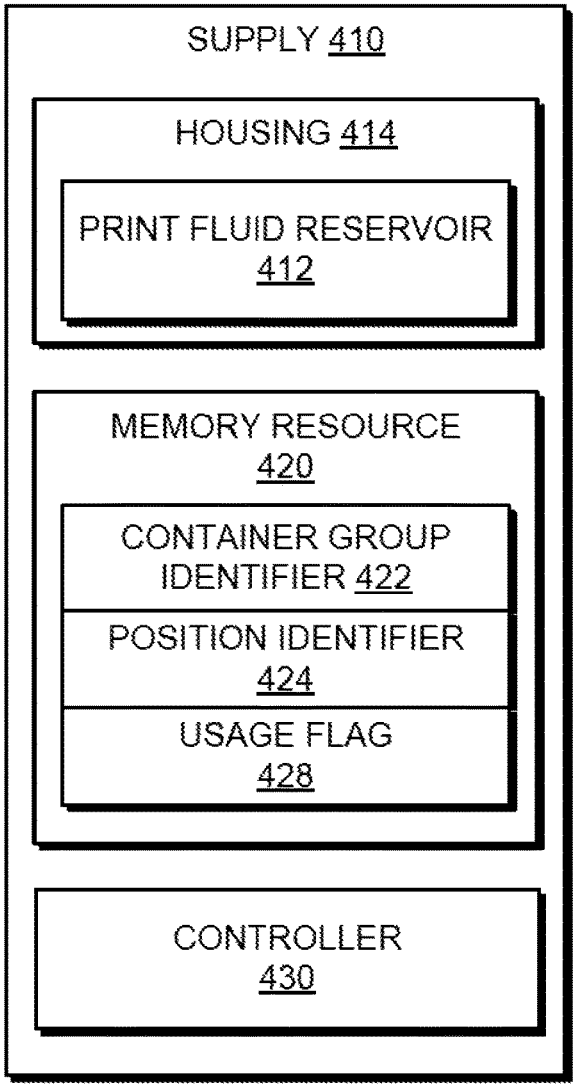

FIGS. 3 and 4 are block diagrams depicting example supplies 310 and 410. Referring to FIG. 3, a supply 310 may comprise a housing 314 defining a print fluid reservoir 312 and a memory resource 320 coupled to the housing 314. The memory resource 320 may have information stored on it to indicate properties of the supply 310. For example, the memory resource 320 may be a read-only memory (ROM) having a data structure stored thereon that associates a first memory location to reserve a first data corresponding to a container group identifier 322, associates a second memory location to reserve a second data corresponding to a position identifier 324 of a group position, and associates a third memory location to reserve a third data corresponding to a usage flag 326, where the container group identifier 322, position identifier 324, and usage flag 326 are similar to the container identifier group identifier 222, the position identifier 224, and the usage flag 226 of FIG. 2.

Referring to FIG. 4, the supply 410 may include similar components as discussed with respect to supply 310 of FIG. 3 (e.g., the housing 414 and the memory resource 420 may be the same as the housing 314 and the memory resource 320 of FIG. 3). FIG. 4 depicts that the supply 410 may further include controller 430 coupled to the memory resource 420. The controller 430 may include instructions to, in response to an instruction received from a print device, place the third data in a memory location to represent a usage flag status that indicates the supply has been used in a print device, for example.

Figure 5:
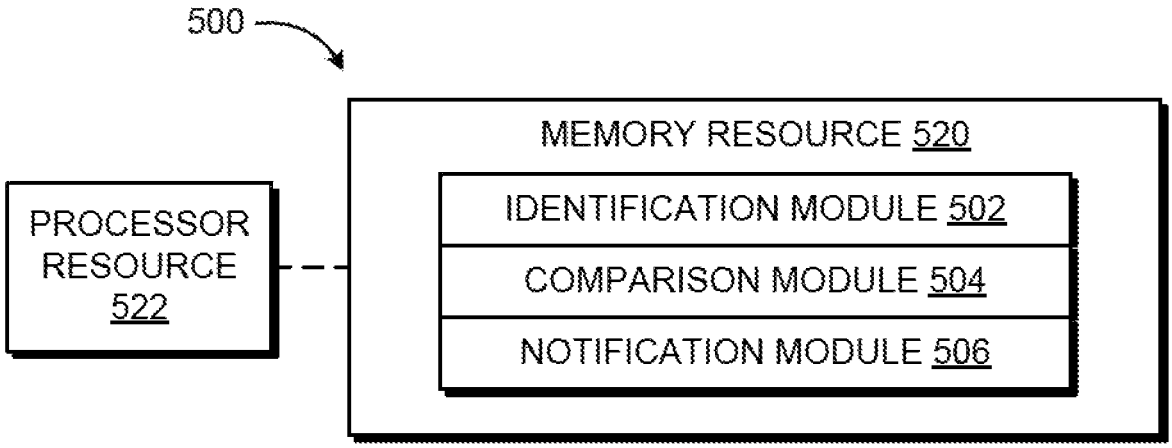
FIGS. 5 and 6 are block diagrams depicting example controller systems.
Figure 6:
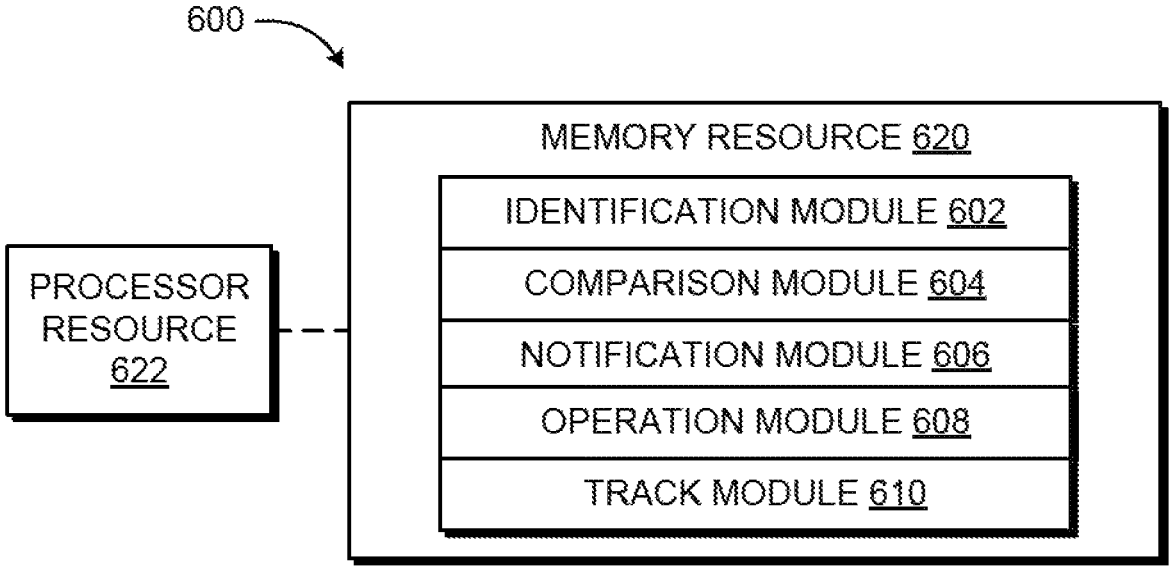

FIGS. 5 and 6 are block diagrams depicting example controller systems 500 and 600. As used herein, a controller may be any circuitry or combination of circuitry and executable instructions to perform a set of control operations. For example, a controller may be system on a chip where a processor is coupled to a memory resource with instructions for a control program stored thereon to operate the controller according to the control program. The controller that performs the operations discussed herein may be located on a print system, such as print system 100 of FIG. 1 and print system 200 of FIG. 2, or on a supply, such as supply 410 of FIG. 4.

FIG. 5 depicts the example system 500 may comprise a memory resource 520 operatively coupled to a processor resource 522. Referring to FIG. 5, the memory resource 520 may contain a set of instructions that are executable by the processor resource 522. The set of instructions are operable to cause the processor resource 522 to perform operations of the system 500 when the set of instructions are executed by the processor resource 522. The set of instructions stored on the memory resource 520 may be represented as an identification module 502, a comparison module 504, and a notification module 506. The identification module 502, the comparison module 504, and the notification module 506 represent program instructions that when executed to perform operations of the system 500. The processor resource 522 may carry out a set of instructions to execute the modules 502, 504, and 506, and/or any other appropriate operations among and/or associated with the modules of the system 500.

The modules illustrated in FIG. 5 and discussed in other example implementations perform specific functionalities in the examples discussed herein, these and other functionalities may be accomplished, implemented, or realized at different modules or at combinations of modules. For example, two or more modules illustrated and/or discussed as separate may be combined into a module that performs the functionalities discussed in relation to the two modules. As another example, functionalities performed at one module as discussed in relation to these examples may be performed at a different module or different modules. FIG. 6 is an example of another combination of modules and includes an operation module 608 and a track module 610 that include instructions to enable, disable, or perform operations of the print system and track supplies that have been attached to a print system, respectively.

Although these particular modules and various other modules are illustrated and discussed, other combinations or sub-combinations of modules may be included within other implementations and functionalities described herein in relation to any of FIGS. 1-6 may be provided in combination with functionalities described herein in relation to any other Figure or example herein.

The system 500 and system 600 may perform operations via execution of program instructions usable with a group reference. For example, the processor resource 522 may carry out a set of instructions to identify a container group identifier associated with a supply of print fluid; compare the container group identifier to a group reference; and, in response to a determination that the container group identifier does not correspond to the group reference, cause a notification to be sent to a console to indicate that the supply corresponds to a different group than the group reference. For another example, the processor resource 522 may carry out a set of instructions to determine a position identifier of the supply in the group corresponding to the container group identifier and cause a notification to appear on the console to indicate a supply position corresponding to the position identifier and the group corresponding to the container group identifier. For yet another example, the processor resource 522 may carry out a set of instructions to determine a usage flag status of the supply based on data retrieved from a machine-readable medium on the supply and, in response to a determination that the position identifier corresponds to a first position and that the usage flag status of the supply indicates the supply has been previously inserted into a previous print system, cause a notification to appear on the console to indicate the supply belongs to the previous print system.

As mentioned above, FIG. 6 represents another possible combination of operations to be executed. For example, the processor resource 622 may carry out a set of instructions to identify a container group identifier associated with a supply of print fluid; compare the container group identifier to a group reference; identify an authorization level of the supply based on the data retrieved from the machine-readable medium on the supply; and, in response to the authorization level being at or above a threshold, cause an indication that a new group reference is being used and automatically perform a color calibration operation on a print device. For another example, the processor resource 622 may carry out a set of instructions to identify an authorization level of the supply based on the data retrieved from the machine-readable medium on the supply and, in response to a determination that the container group identifier corresponds to a group different from the group reference and the authorization level being below a threshold, cause an indication that the supply is not authorized to initiate a new group reference. For yet another example, the processor resource 622 may carry out a set of instructions to track, in a data structure, a container-specific identifier of a container used in a print device and a group number corresponding to the container-specific information; look up, in the data structure, the group number associated with the group identifier; cause a notification to describe whether the group identifier was found in the data structure; enable a feature of the print device based on whether the group identifier was found in the data structure; or disable a feature of the print device based on whether the group identifier was not found in the data structure. Data structures may be used herein to organize data useable by the systems 500 and 600, such as a table or database may be used to track information for each container used by the print system in the previous example. The information used in such a data structure may include serial numbers or other container-specific information, as well as group information, usage information, authorization level information, operational features, print settings, and color calibration information corresponding to each container inserted into the print system.

The processor resources 522 and 622 are any appropriate circuitry capable of processing (e.g., computing) instructions, such as one or multiple processing elements capable of retrieving instructions from a memory resource (e.g., memory resource 520 or 620) and executing those instructions. For example, the processor resource 522 may be a central processing unit (CPU) that enables print operations based on group reference comparison by fetching, decoding, and executing modules 502, 504, and 506. Example processor resources include at least one CPU, a semiconductor-based microprocessor, a programmable logic device (PLD), and the like. Example PLDs include an application specific integrated circuit (ASIC), a field-programmable gate array (FPGA), a programmable array logic (PAL), a complex programmable logic device (CPLD), and an erasable programmable logic device (EPLD). A processor resource may include multiple processing elements that are integrated in a single device or distributed across devices. The processor resource 522 and 622 may process the instructions serially, concurrently, or in partial concurrence.

The memory resources 520 and 620 represents a medium to store data utilized and/or produced by the print system and/or controller on the supply. The medium is any non-transitory medium or combination of non-transitory media able to electronically store data, such as modules of the systems 500 and 600 and/or data used by the system 500 and 600. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be said to store program instructions that when executed by a processor resource cause the processor resource to implement functionality of the system (e.g., systems 500 or 600). The memory resource may be integrated in the same device as the processor resource or it may be separate but accessible to that device and the processor resource. The memory resource may be distributed across devices.

In the discussion herein, the controllers 104, 204, and 430 and the systems 500 and 600 of FIGS. 1-6 have been described as circuitry or a combination of circuitry and executable instructions. Such components may be implemented in a number of fashions. Looking at FIG. 5, the executable instructions may be processor-executable instructions, such as program instructions, stored on the memory resource 520, which is a tangible, non-transitory computer-readable storage medium, and the circuitry may be electronic circuitry, such as processor resource 522, for executing those instructions. The instructions residing on the memory resource 520 may comprise any set of instructions to be executed directly (such as machine code) or indirectly (such as a script) by the processor resource 522.

Figure 7:
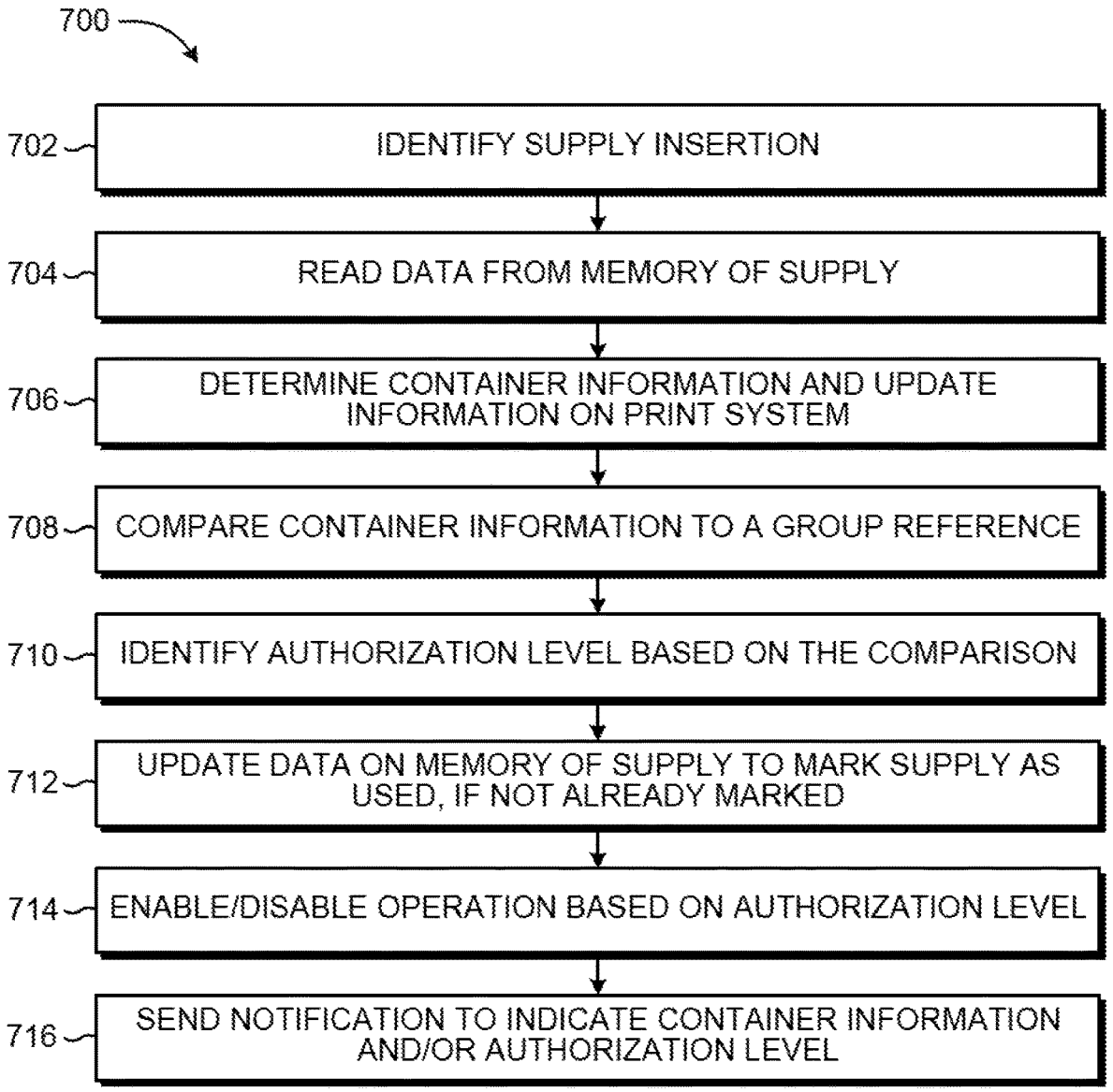
FIG. 7 is flow diagram depicting an example method of operating an example print system.

In some examples, the systems 500 and 600 may include executable instructions as part of an installation package that when installed may be executed by a processor resource to perform operations of the respective system, such as methods described with regards to FIG. 7. In that example, the memory resource 520 may be a portable medium such as a compact disc, a digital video disc, a flash drive, or memory maintained by a computer device, such as a web server, from which the installation package may be downloaded and installed. In another example, the executable instructions may be part of an application or applications already installed. The memory resources 520 and 620 may be a non-volatile memory resource such as read only memory (ROM), a volatile memory resource such as random access memory (RAM), a storage device, or a combination thereof. Example forms of a memory resource include static RAM (SRAM), dynamic RAM (DRAM), electrically erasable programmable ROM (EEPROM), flash memory, or the like. The memory resource may include integrated memory such as a hard drive (HD), a solid state drive (SSD), or an optical drive.

FIG. 7 is a flow diagram depicting an example method 700 of operating an example print system, such as print systems 100 and 200 of FIGS. 1-2. Referring to FIG. 7, example methods for printer operation using a group reference may generally comprise reading data from an inserted supply, comparing container information to a group reference, identifying an authorization level based on the comparison, and performing an operation based on the authorization level. The method described with regards to FIG. 7 is performable by a controller of a print system, such as controllers 104, 204, 430, 500, and 600.

At block 702, insertion of a supply is identified, and data is read from memory coupled to the supply at block 704. The data is then used to determine container information associated with the supply at block 706 and any data references on a print system are updated accordingly. The container information may be directly retrievable from the supply or may be computed or otherwise identified based on the data retrieved from the supply. For example, the container information may include a container group identifier representing the batch number corresponding the batch associated with the ink in the supply and a position identifier associated with a position of the supply in the group (e.g., to identify an order of installation of the batch and/or particular supplies in the batch).

At block 708, the container information is compared to a group reference. The container information may be compared for exact matches or equivalence. For example, the container group identifier may be a particular value and a group reference may be a range of values. For another example, the batch group may be any odd numbers associated with serial numbers. For yet another example, container information may be used to identify an order of installation of the supplies, such as determine a position of the supply to be used in order of other supplies in the group. At block 710, an authorization level is identified based on a comparison. For example, the group of the container may match the group reference and a full authorization may be enable for the supply, whereas a mismatch may set the authorization level to a relatively lower authorization level. For another example, containers with serial numbers that are odd may have a different authorization level than containers with even serial numbers.

At block 712, data on the memory of the supply is updated to mark the supply as used, if the container is not already marked as used for example. For example, the print system may determine the usage flag state and may set the usage flag on the supply to indicate the supply is used.

At block 714, an operation of the print system may be enabled or disabled based on authorization level. The authorization level may be associated with a set of operations to be enabled. For example, an authorization level may be associated with an authorization profile that corresponds to a combination of settings and a number of functions to set and enable on the print system. The usage flag may be used as container information in association with the authorization level to enable or perform certain functions. For example, a supply that is inserted for its first usage may automatically perform a color calibration.

At block 716, a notification is sent (e.g., to a control panel) to indicate container information and/or authorization level. Such a notification may allow the user to ensure the correct supply has been entered into the print system (e.g., by providing a warning of mismatch or an indication of group match) or remind the user to complete a routine, such as a calibration operation or service operation.

Although the flow diagram of FIG. 7 illustrates a specific order of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described with reference to the foregoing examples. It is understood, however, that other forms, details, and examples may be made without departing from the spirit and scope of the following claims. The usage of the words "first," "second," or related terms in the claims are not used to limit the claim elements to an order or location, but are merely used to distinguish separate claim elements.

What is claimed is:

1. A print system comprising:

a supply interface to form electrical communication with a container of print fluid; and a controller to:

retrieve, via the supply interface, data from a machine-readable medium coupled to the container;

identify a container group identifier based on the retrieved data; and set a group flag based on a comparison of the container group identifier with data representing a group reference.

2. The system of claim 1, wherein the controller is to:

in response to a determination that the group flag indicates a mismatch between the container group identifier and the group reference, cause data to be written to a machine-writeable medium coupled to the container.

3. The system of claim 2, wherein the controller is to:

in response to the determination that the group flag indicates a mismatch between the container group identifier and the group reference, update the group reference and cause a notification to a control panel on the print system.

4. The system of claim 1, wherein the controller is to: enable a print mode based on the group flag; or perform color calibration based on the group flag.

5. The system of claim 1, wherein the controller is to: in response to a change to the group flag, cause an interrupt routine to switch operational status of a feature of the print system.

6. The system of claim 1, wherein the controller is to: determine a use flag status using the retrieved data; and when the usage flag status indicates an initial use, cause data to be written to a machine-writeable medium coupled to the container.

7. The system of claim 6, wherein the machine-readable medium and the machine-writable medium are the same medium and the data to be written includes printer identifiable information.

* * * * *